US005151078A

United States Patent [19]

Lin

[11] Patent Number: 5,151,078

[45] Date of Patent: Sep. 29, 1992

[54] METHOD FOR FOLDING PIECES OF PAPER INTO LETTERS OF THE ALPHABET

[76] Inventor: Yi-Teh Lin, Shihtsuo 76, 4th Lin, Shihtsuo Village, Mailiao Hsiang, Yunlin County, Taiwan

[21] Appl. No.: 816,875

[22] Filed: Jan. 2, 1992

[51] Int. Cl.[5] ..... B65H 45/12

[52] U.S. Cl. ..... 493/405; 493/959; 462/68; 283/117; 40/539

[58] Field of Search ..... 493/405, 955, 959; 462/68; 283/117; 40/539

[56] References Cited

U.S. PATENT DOCUMENTS

| | | | |
|---|---|---|---|
| 2,141,235 | 12/1938 | Angeletti | 493/955 |
| 2,897,971 | 8/1959 | Gewiss | 493/405 |
| 4,227,334 | 10/1980 | Hooker | 493/405 |
| 4,319,941 | 3/1982 | Brownell | 493/405 |
| 4,327,516 | 5/1982 | Lubozynski | 493/959 |
| 5,000,717 | 3/1991 | Pfeiffer | 40/539 |
| 5,024,012 | 6/1991 | Louk | 40/539 |

*Primary Examiner*—William E. Terrell
*Attorney, Agent, or Firm*—Gifford, Groh, Sprinkle, Patmore and Anderson

[57] ABSTRACT

A method for folding paper into letters of the alphabet. The method has defining a rectangular piece of paper with an X-axis paralel to a width thereof and a Y-axis parallel to a length thereof, folding the piece of paper into the shape of an alphabetic letter at lines parallel to the X-axis, thereby dividing the piece of paper into a plurality of segments, in segments to be formed into curves, defining a plurality of alternative lines X′ and X″ parallel to the X-axis so that a sub-segment of paper between every two sequential lines X′ and X″ is longer than a sub-segment of paper between every two sequential lines X″ and X′, corrugating the piece of paper at the alternative lines X′ and X″, corrugating the piece of paper at lines parallel to the Y-axis, and bending the folded and corrugated piece of paper into an alphabetic shape.

4 Claims, 6 Drawing Sheets

METHOD FOR FOLDING PIECES OF PAPER INTO LETTERS OF THE ALPHABET

BACKGROUND OF THE INVENTION

The present invention relates to a method for folding pieces of paper into letters of the alphabet.

People have been using paper-folding for training their children to exercise both their hands and minds. In primary schools, art classes teach students many methods of folding pieces of paper into different configurations, e.g., animals, birds, ships, and planes. There has not, however, been any method which teaches how to fold pieces of paper into letters of the alphabet. To make letters of the alphabet, scissors are needed to cut pieces of paper into the alphabet. The present invention provides a method for making letters of the alphabet from pieces of paper without scissors.

SUMMARY OF THE INVENTION

It is an object of the present invention to provide a method for folding pieces of paper into letters of the alphabet. The method has a step of folding a rectangular piece of paper at transverse lines, a step of corrugating the folded pieces of paper at longitudinal lines, and a step of stretching the corrugated piece of paper into a letter.

Additional objects, if not specifically set forth herein, will be readily apparent to those skilled in the art from the detailed description of embodiments below, with reference of the accompanying drawings.

Figure 1A:
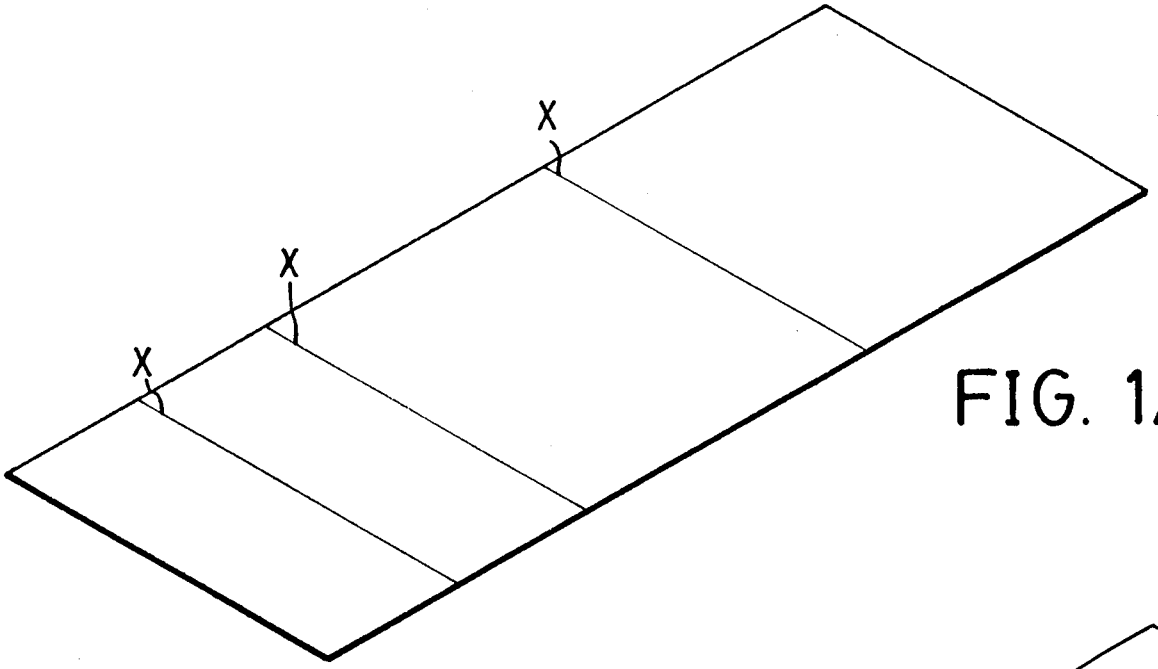
FIG. 1A through 1F diagrams showing sequential steps of folding a rectangular piece of paper into the letter "A" in accordance with the present invention.

Preferred embodiments as shown in the drawings are not used for limitation but for illustration of the present invention.

DETAILED DESCRIPTION OF THE PREFERRED EMBODIMENT

This invention is to be understood by description of the preferred embodiments with reference to the drawings.

Figure 1C:
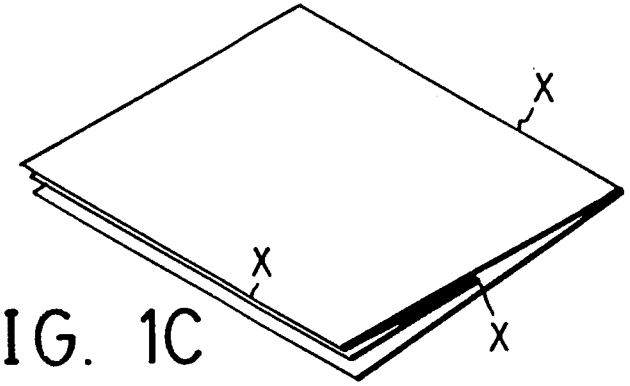
Figure 1D:
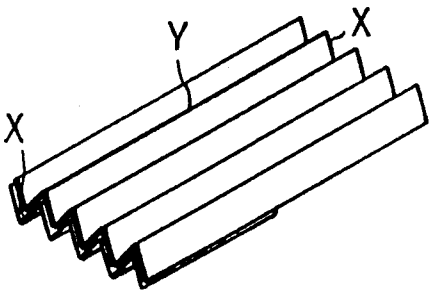
Figure 1E:
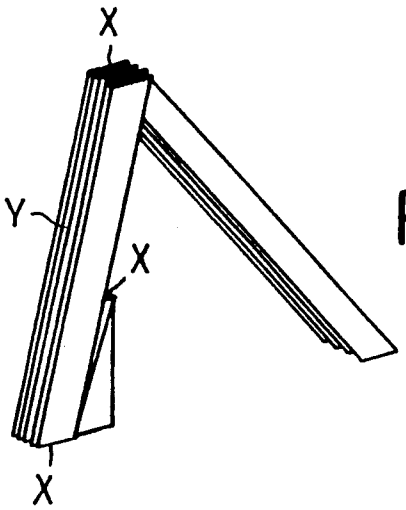
Figure 1F:
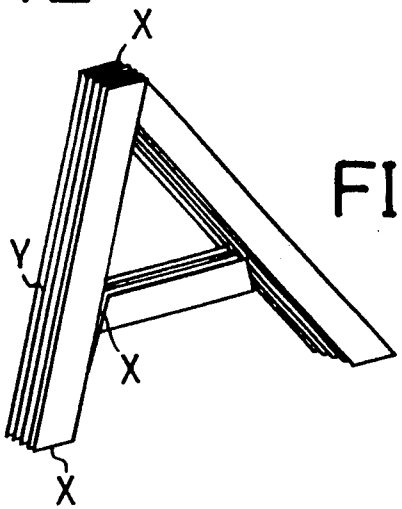

A first embodiment in accordance with the present invention is described with reference to FIGS. 1A through 1F. Referring to FIG. 1A, a rectangular piece of paper is properly creased with transverse lines X, so that the piece of paper obtains an A-shaped configuration when viewed from a direction indicated by the arrow in FIG. 1B when folded at the transverse lines X. Referring to FIG. 1C, the transversely folded rectangular piece of paper is folded flat. Referring to FIG. 1D, the transversely folded piece of paper is corrugated at longitudinal lines Y. Referring to FIG. 1E, the folded and corrugated piece of paper is pivoted open. Referring to FIG. 1F, the piece of paper is folded into the letter "A".

Figure 2B:
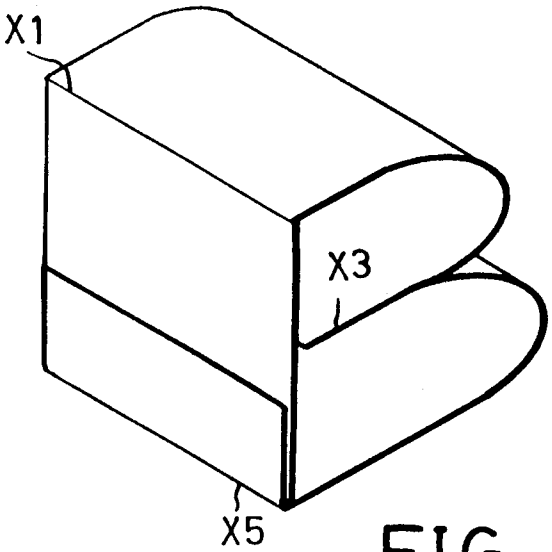
FIG. 2A through 2F are diagrams showing sequential steps of folding a rectangular piece of paper into the letter "B" in accordance with the present invention.
Figure 2C:
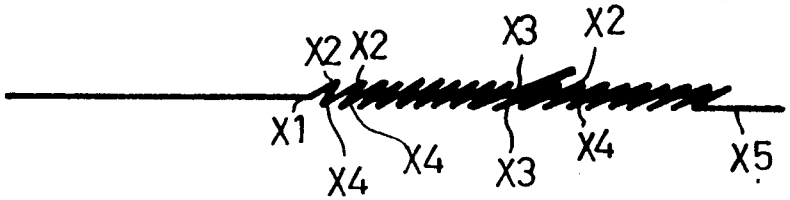
Figure 1B:
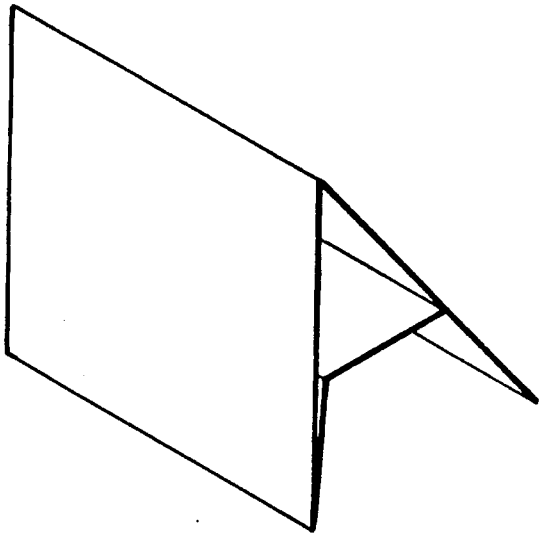
Figure 2A:
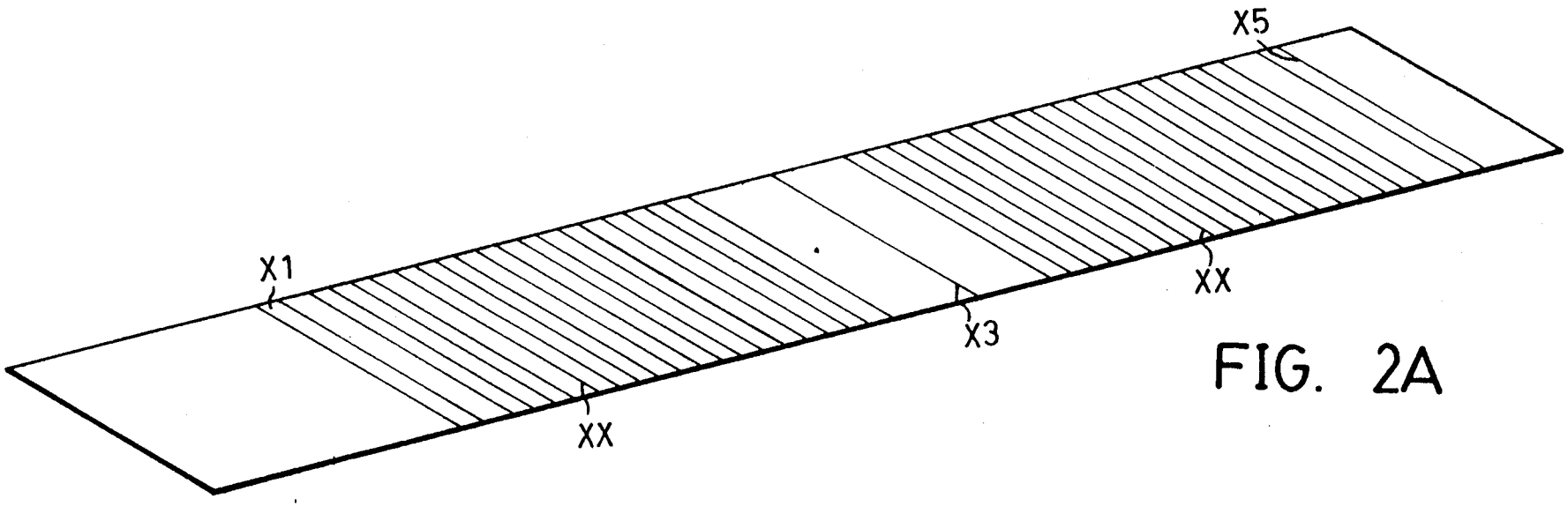

A second embodiment in accordance with the present invention is described with reference to FIGS. 2A through 2F. Referring to FIG. 2A, the rectangular piece of paper is properly creased with transverse lines X1, X2, and X3, so that it obtains a B-shaped configuration as viewed in a direction indicated by the arrow in FIG. 2B when folded at the lines X1, X2, and X3. The segment of paper between the lines X1 and X3 and the segment of paper between the lines X3 and X5 are relatively long compared to the segment of paper beyond the line X1, as they need further manipulation.

Figure 2D:
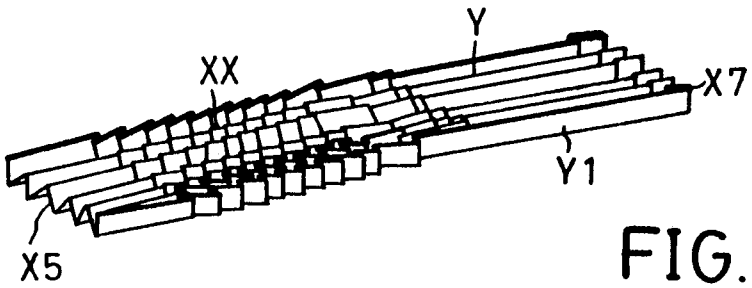
Figure 2F:
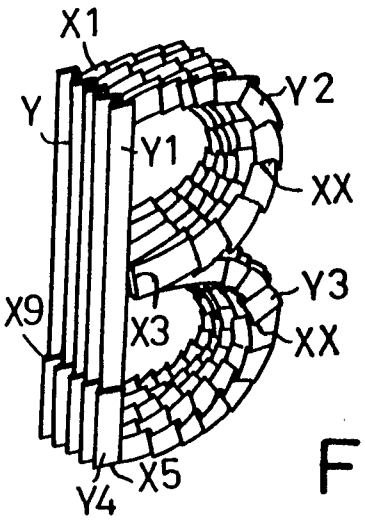
Figure 2E:
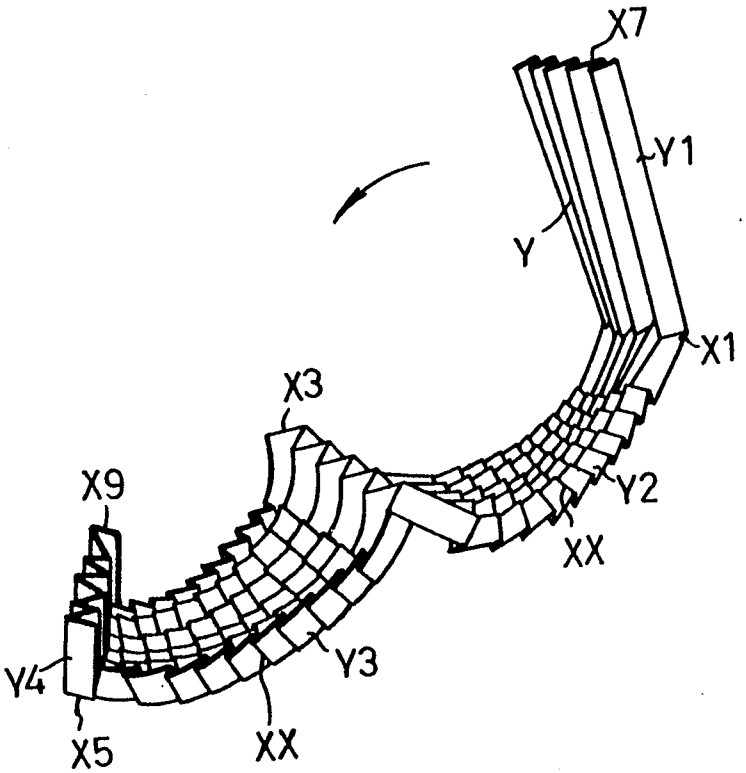

The segment of paper between lines X1 and X3 is creased with a first set of alternative lines X2 and X4, leaving a relatively short flat segment of paper between the last line X4 thereof and the line X3. The segment of paper between the lines X3 and X5 is creased with a second set of alternative lines X2 and X4, leaving a relatively short flat segment between the first line X2 thereof and the line X3. A segment between every two sequential lines X2 and X4 is shorter than a segment between every two sequential lines X4 and X2 in a direction indicated by the arrows. Referring to FIG. 2C, as shown in a side view, the piece of paper is corrugated at the alternative lines X2 and X4. Referring to FIG. 2D, the transversely folded piece of paper is corrugated at longitudinal lines Y. Referring to FIG. 2E, the piece of paper is bent in a direction indicated by the arrow. Referring to FIG. 2F, the piece of paper is folded into the letter "B".

Figure 3A:
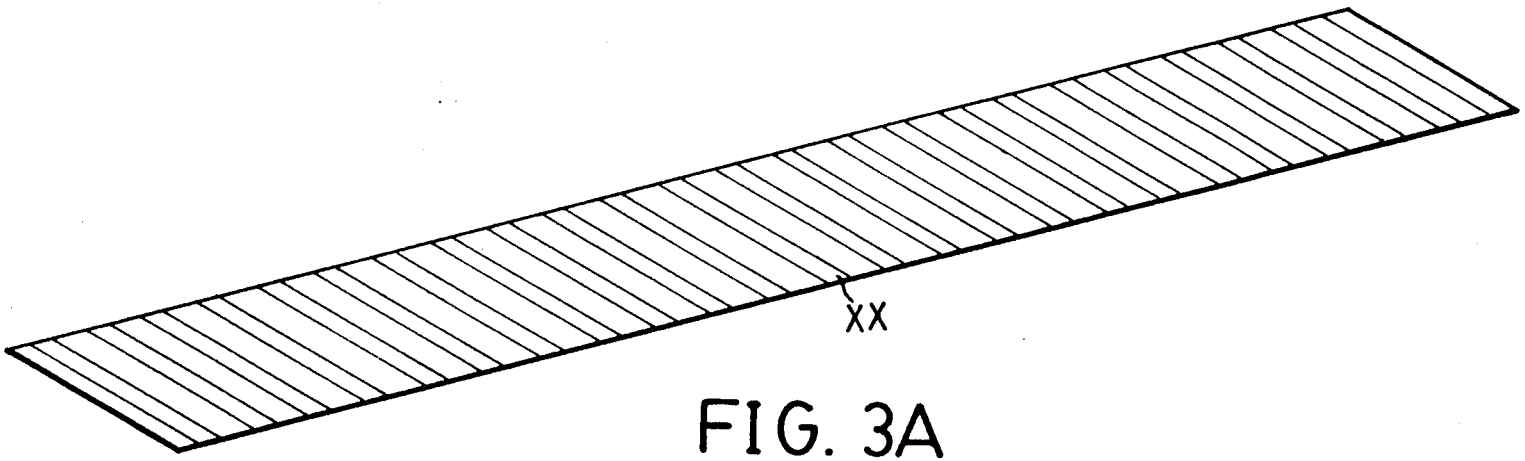
FIG. 3A through 3C are diagrams showing sequential steps of folding a rectangular piece of paper into the letter "C" in accordance with the present invention.
Figure 3B:
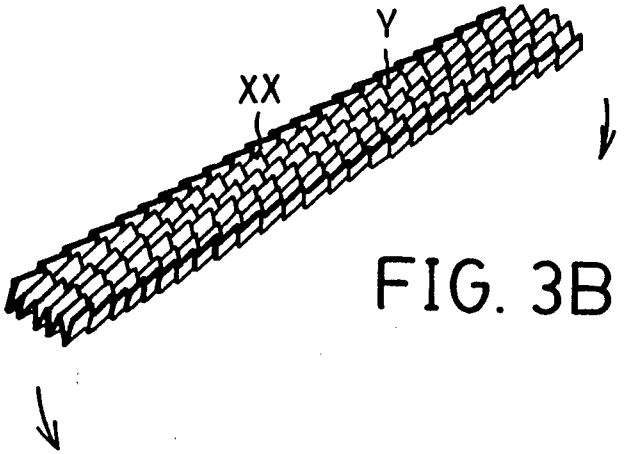
Figure 3C:
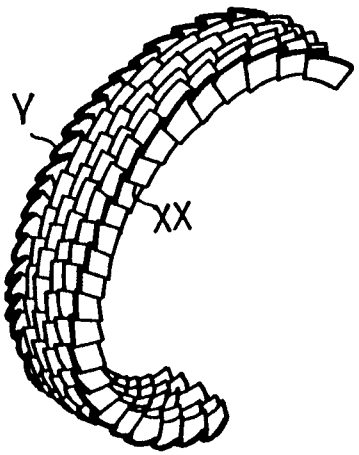

A third embodiment in accordance with the present invention is described with reference to FIGS. 3A through 3C. Referring to FIG. 3A, a rectangular piece of paper is creased with a plurality of alternative lines X2 and X4. Referring to FIG. 3B, the piece of paper is corrugated at lines X2 and X4 and corrugated at lines Y. Referring to FIG. 3C, the corrugated piece of paper is bent to form the letter "C".

The method in accordance with the present invention also works with other letters of the alphabet. Straight segments of letters of the alphabet are folded based on the steps as shown in FIGS. 1A through 1E. Curvilinear segments of letters of the alphabet are folded based on the steps as shown in FIGS. 2A through 2F.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A method for folding paper into alphabet letter shapes, comprising:

defining a rectangular piece of paper with an X-axis parallel to a width thereof and a Y-axis parallel to a length thereof;

folding the piece of paper into an alphabetic letter at lines parallel to X-axis, thereby dividing said piece of paper into a plurality of segments;

in segments to be formed into curves, defining a plurality of alternative lines X′ and X″ parallel to said X-axis so that a sub-segment of paper between every two sequential lines X′ and X″ is longer than a sub-segment of paper between every two sequential lines X″ and X′;

corrugating the piece of paper at said alternative lines X′ and X″;

corrugating the piece of paper at lines parallel to said Y-axis; and bending said folded and corrugated piece of paper into an alphabetic letter shape.

2. The method according to claim 1 wherein said corrugated paper is stretched into alphabet letter shapes.

3. The method according to claim 2 wherein said alphabet letter shapes are formed into the shapes of the straight letters of the alphabet by stretching.

4. The method of folding paper according to claim 2 wherein said alphabet letter shapes are formed into the shapes of the curved letters of the alphabet by stretching.

* * * * *